United States Patent [19]

Newton et al.

[11] Patent Number: 4,833,866

[45] Date of Patent: May 30, 1989

[54] BALED NUCLEAR WASTE BOX HANDLER

[75] Inventors: Glen E. Newton, Arlington; Peter C. Cole, Duncanville, both of Tex.

[73] Assignee: MAC Corporation of America, Grand Prairie, Tex.

[21] Appl. No.: 67,537

[22] Filed: Jun. 29, 1987

[51] Int. Cl.[4] ..... B65B 1/24; B65B 1/36; B65B 5/10

[52] U.S. Cl. ..... 53/529; 53/246; 100/229 A

[58] Field of Search ..... 53/529, 246, 534, 438, 53/475; 100/224, 225, 229 A, 229 R

[56] References Cited

U.S. PATENT DOCUMENTS

| | | | |
|---|---|---|---|
| 71,544 | 11/1867 | Smith . | |
| 798,609 | 9/1905 | Lassig et al. | 53/246 |
| 3,721,060 | 3/1973 | Quinto | 53/529 X |
| 3,735,561 | 5/1973 | Wood | 53/246 X |
| 4,034,918 | 7/1977 | Culbertson et al. | 241/36 |
| 4,057,010 | 11/1977 | Smith | 100/50 |
| 4,182,237 | 1/1980 | O'Brien | 53/529 X |
| 4,425,843 | 1/1984 | Jacobsen et al. | 100/229 A |
| 4,681,706 | 7/1987 | Mallory et al. | 53/529 X |
| 4,683,110 | 7/1987 | Baudro et al. | 53/246 X |
| 4,703,611 | 11/1987 | Young | 53/529 |

OTHER PUBLICATIONS

Appendix A-3 photographs (No Date).

The MAC Corporation/Saturn Shredders Catalog MA 1183-5 (No Date).

The MAC Corporation/Saturn Shredders Catalog MA6/86-10 (No Date).

*Primary Examiner*—James F. Coan

*Attorney, Agent, or Firm*—Richards, Harris, Medlock & Andrews

[57] ABSTRACT

An improved system (10) is provided for loading compacted waste bales (34) in each compartment (22, 24, 26) of a container (14). The system (10) includes a container handling apparatus (12) which sequentially positions each of the compartments before the discharge opening (32) of a compactor assembly (18) for receiving a bale. Further, a control circuit is provided which controls the operation of the compacting ram (20) so that an overlength bale is prevented.

12 Claims, 3 Drawing Sheets

88
88
88
12
64
68
74
74
74
70
80
66
90
90
4
4
108
108
82
76
106
115
115
78
100
84
100
92
5
5
104
102
102
72

BALED NUCLEAR WASTE BOX HANDLER

TECHNICAL FIELD

This invention relates to container handling, and in particular to positioning a multicompartment container for receiving waste in bale form.

BACKGROUND OF THE INVENTION

Radioactive material is used in numerous industries, the most well known being the nuclear power industry. The problems of safely disposing of high level nuclear waste are well known. However, there is also a need to safely dispose of low level nuclear waste materials, which can include such things as lab clothing, brooms, containers, drums, etc. which have been exposed to low level nuclear radiation. While the level of radioactivity in these materials is not of critical concern, the materials must still be disposed of properly, and the shear bulk and diversity of form that these materials take create significant problems in disposal.

One solution to the problem of low level nuclear waste has been to shred the materials into small pieces and then compact those pieces to a high density. Because these materials can range from cloth to steel, for example, both the shredder and compactor must be suitably constructed. Such units are available and commonly are capable of producing a bale of compacted material of predetermined dimensions and density.

Regulations require that the waste be contained within a suitable container. Thus, the compacted bale must be transferred from the shredder and compactor to the container. To minimize human contact with the bale, it would clearly be desirable to automate such a procedure as fully as possible. Furthermore, typical waste containers have multiple compartments separated by divider walls. Thus, it is necessary to position each compartment in the container in sequence to receive a bale.

SUMMARY OF THE INVENTION

In accordance with one aspect of the present invention, an apparatus is provided for facilitating the loading of bales of compacted waste from a compactor into a multicompartment container, each bale being discharged from the compactor through a discharge opening of predetermined horizontal and vertical dimensions. Each compartment of the container has an opening of similar dimensions. The apparatus includes a stationary frame positioned proximate the discharge opening of the compactor. A first movable frame is slidably mounted within the stationary frame. First guide structure is provided for guiding the moveable frame for movement in a first direction within a plane parallel the discharge opening for sequentially aligning the opening of each of the compartments with the discharge opening of the compactor to receive a bale.

In accordance with another aspect of the present invention, a second movable frame is slidably mounted to the first movable frame for movement in a second direction perpendicular the plane of the discharge opening, permitting the container to be moved toward the discharge opening to load a bale and away from the discharge opening to move the first frame and container in the first direction for presenting an empty compartment to the discharge opening.

In accordance with another aspect of the present invention, the stationary frame includes a plurality of guide members, each defining a guide surface extending along the first direction. The first movable frame is provided with cooperating guide surfaces so that the fixed frame supports and guides the first movable frame along the first direction. In accordance with another aspect of the present invention, structure is provided at each of the cooperating guide surfaces between the stationary frame and first movable frame for moving the first movable frame along the first direction.

In accordance with another aspect of the present invention, a second movable frame is slidably mounted to the first movable frame for movement toward and away from the discharge opening. The discharge opening is provided with guide structure to guide the opening in a compartment of the container into alignment with the discharge opening as the container is moved toward the discharge opening.

BRIEF DESCRIPTION OF THE DRAWINGS

A more complete understanding of the invention and its advantages will be apparent from the following Detailed Description when taken in conjunction with the accompanying drawings, in which.

DETAILED DESCRIPTION

Figure 1:
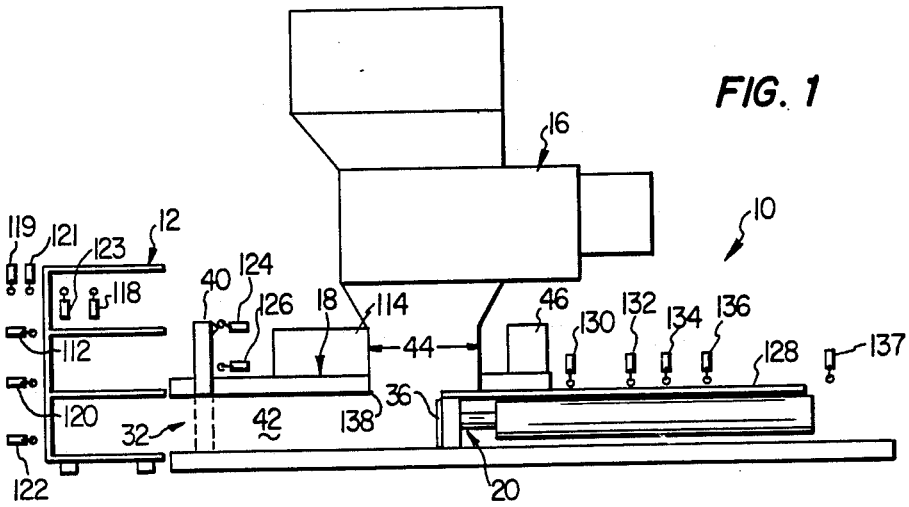
FIG. 1 is a side view of a shredder and compactor for baling low level nuclear waste and a first embodiment of a container handling apparatus for handling a container to receive the baled waste.

Referring now to the drawings, wherein like reference characters designate like or corresponding parts throughout the several views, and in particular to FIG. 1, a system 10 is illustrated which acts to shred low level nuclear waste material, compact the material into a bale of precise dimensions and pack the bales using a container handling apparatus 12 into a container 14 for eventual storage.

The system 10 includes a shredder assembly 16 which preferably is formed of parallel rotating shredding members of sufficient strength and operated with sufficient power to shred virtually any material put into the system, including metal containers, etc. The system 10 also is provided with a compactor assembly 18 which includes a hydraulic ram 20 which takes the shredded material and compresses it into a bale of high density within the assembly. The shredder and compactor assemblies can be of the type provided by Mac Corporation of 201 East Shady Grove Road, Grand Prairie, Tex. 75050, the assignee of all rights in the present invention.

Figure 2:
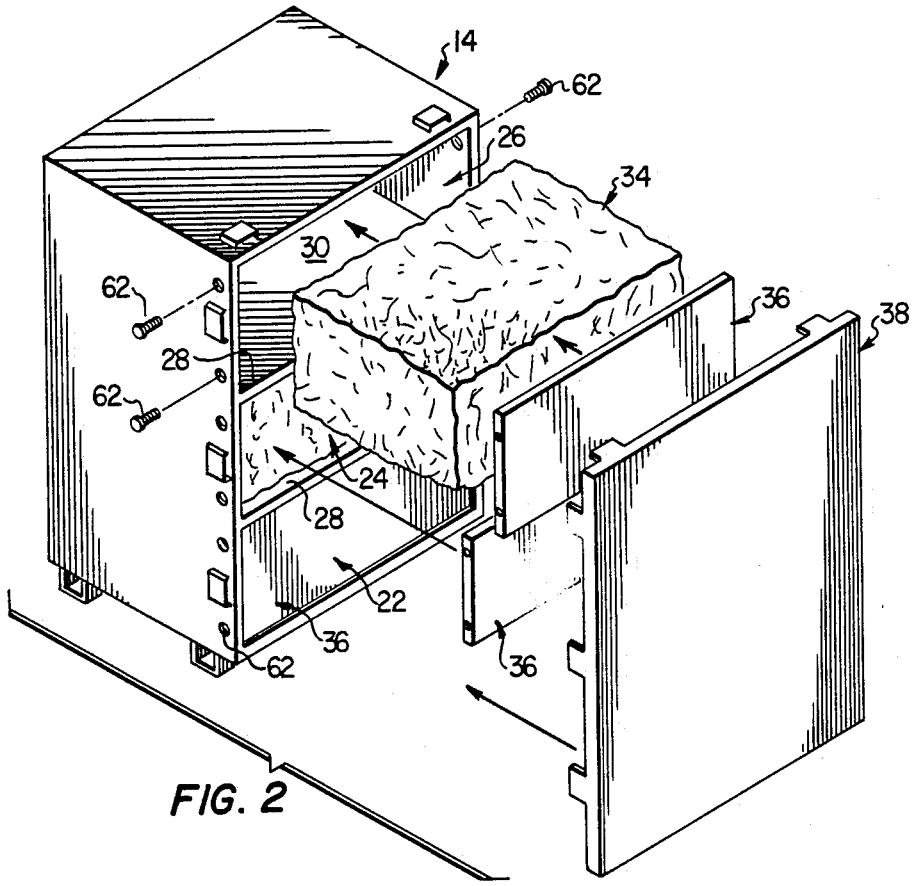
FIG. 2 is an exploded perspective view of a container for use with the container handling apparatus.

As best seen in FIG. 2, the container 14 is preferably a multicompartment container. As illustrated, container 14 has three compartments 22, 24 and 26, each of equal dimensions and separated from the adjacent compartment by dividing walls 28. Each of the compartments has an opening 30 on one side of the container which is identical in dimensions with the other openings.

The container handling apparatus 12 is designed for positioning an opening 30 of a compartment in the container 14 before the discharge opening 32 of the compactor assembly. As will be discussed in greater detail hereinafter, the dimensions of the discharge opening 32 are substantially equivalent to the dimensions of each opening 30 so that a compacted waste bale 34 can be transferred from the compactor assembly to each compartment. The container handling apparatus 12 sequentially positions each of the openings 30 in a container 14 before the discharge opening for receiving a bale of waste until the entire container is filled. Temporary covers 36 are secured over each compartment after the compartment is filled with a bale until all of the compartments are filled. The container can then be removed from apparatus 12 and the permanent cover 38 secured on the container 14. The container 14 then can be disposed of in a manner suitable for disposal of low level nuclear waste under the relevant governmental requirements.

With reference now to FIG. 1, the detailed operation of the compactor assembly 18 can be described in greater detail. In the compaction mode, a gate 40 closes off the discharge opening 32 to provide an enclosed compaction chamber 42 in which the hydraulic ram 20 compacts the waste material.

The range of motion of the hydraulic ram 20 extends from adjacent the gate 40 to back of the opening 44 through which the shredded material falls into the compactor assembly from the shredder assembly. For example, the total stroke of the hydraulic ram 20 can be 86 inches. The length of the opening 44 can be 34 inches. The desired waste bale will have a compressed length of between 38 and 40 inches.

In the initial stages of compaction, the hydraulic ram 20 is completely withdrawn to allow the entire opening 44 to lie in front of the ram. The ram 20 is then driven forward, driving shredded waste before it toward the gate 40. The material is compacted to the desired density by exerting a predetermined force from hydraulic ram cylinder 45, through the ram against the shredded material.

As the compacted bale approaches its final length, it is possible that a complete cycle of the hydraulic ram would permit so much shredded material to enter the compaction chamber that the next compression stroke creates a bale of excess length. As the dimensions of the container 14 are set, excessive length in the bale is unacceptable. However, slightly under length bales are readily accommodated within the containers.

In order to prevent excessive length bales, a control 46 is provided which measures the length of each stroke of the hydraulic ram 20 with a photo eye assembly 48 as the bale is formed. The control 46 will provide a running average of the additional bale length added for each stroke of the ram 20 and also the incremental addition to bale length added by the last stroke. When the length of the bale grows to a point where it is longer than the difference of the optimal bale length minus the larger of either the average incremental length added per stroke, or the last incremental length added, the control then calculates a ratio of the additional length needed on the bale to form a bale of desired length divided by the larger of the average incremental length or last incremental length and withdraws the ram so that only that ratio of the total length of the opening 44 is opened for shredded material to fall in front of the ram for the final stroke. The final stroke of the ram thus prevents compacting a bale exceeding the desired length in all but the very rarest cases.

Ram 20 mounts a sliding plate 128 to prevent shredded material from falling through the opening 44 behind the ram. Plate 128 activates various limit switches as ram 20 moves to control the ram motion. Switch 130 indicates movement of the ram to its forward limit at gate 40. Switch 132 indicates a full stroke is possible. Switch 134 indicates the bale length is not exceeded. Switch 136 indicates the face of the ram 20 is at the shear edge 138 of opening 44. A full back switch 137 indicates the ram is fully retracted and reinitializes the motion counting sequence for each stroke. While the described embodiment of the invention utilizes limits switches for position sensory, clearly proximity probes, or other position sensing components could be utilized as well.

As an example, the desired bale length may be in the range of 38 to 40 inches. The total hydraulic ram stroke is 86 inches while the opening 44 is 34 inches long. As the photo eye assembly 48 monitors the travel of the ram, it may sense that the first ram stroke comes within five inches of the gate 40, the second stroke 12 inches, the third stroke 15 inches, the fourth stroke 20 inches, the fifth stroke 26 inches and the sixth stroke 33 inches. This indicates that the incremental increase in bale length per stroke was 5, 7, 3, 5, 6 and 7 inches respectively, forming an average incremental additional length of 5.5 inches per stroke. At the bale length of 33 inches, the control 46 senses that the larger of the two numbers, the last incremental additional length of 7 inches and the average of 5.5 inches, could bring the bale over length as the predicted maximum length would be 40 inches, very close to the maximum tolerance. The control would seek to limit the additional length to the low end of the range, or an additional 5 inches. Thus, the ram would be retracted only 5/7ths of the distance of the opening 44 to reduce the quantity of shredded material dropping from the shredder assembly into the compaction chamber.

Figure 6:
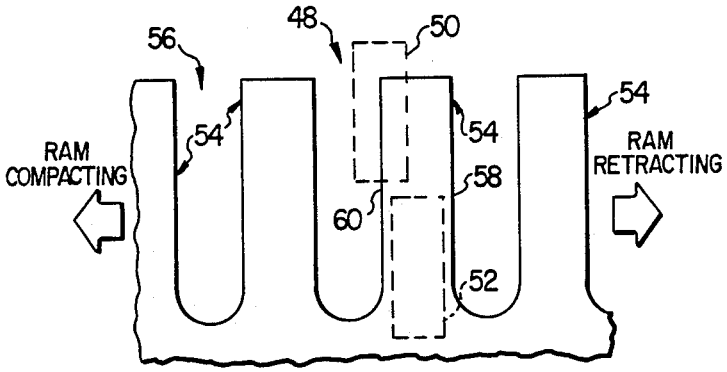
FIG. 6 is a schematic view of the system for controlling the ram motion to prevent generation of an overlong bale.

With reference now to FIG. 6, the details of the photo eye assembly 48 sensing ram movement can be better illustrated. The photo eye assembly 48 includes a first photo eye 50 and a second photo eye 52. Eyes 50 and 52 are preferably retroreflective proximity type detectors which combine a light source and light reception in a single package. A series of stationary fingers 54 extend along the direction of motion of the ram. Each finger has a predetermined width, such as one inch, in this direction and a reflective surface (white paint for example) on the side facing eyes 50 and 52. Each finger is separated by a gap 56 which has a similar width, for example ½ inch. As the ram moves, the photo eyes move over the fingers and gaps, alternately reflecting and not reflecting light respectively from the light source to the receptor in each photo eye.

The first photo eye 50 is used to determine motion of the ram. There are four possible transitions for this photo eye, with the condition of photo eye 50 when a finger reflects light back to the photo eye 50 being "on" and the condition of photo eye 50 when a slot reflects no light to photo eye 50 as "off", including:

1. on (finger over eye) to off (slot over eye) past edge 58 of a finger moving in the direction to retract ram 20 (to the right in FIG. 6).

2. on (finger over eye) to off (slot over eye) past edge 60 of the finger moving the opposite direction to compact material.

3. off (slot over eye) to on (finger over eye) past edge 60 moving to retract the ram.

4. off (slot over eye) to on (finger over eye) past edge 58 moving the opposite direction.

The photo eye assembly 48 is oriented to count transitions from one state to another only when the second photo eye 52 is on. Thus, if the second photo eye 52 is on for counts to be made, when the first photo eye 50 transitions over edge 60 in the retraction direction, a count is made of retraction of the ram the predetermined distance. When movement of the ram is forward for compression, the first photo eye then counts the motion in that direction. This way, a constant record of movement of the ram can be generated. As noted, switch 137 can be used to reinitialize count.

With reference now to FIG. 2, additional detail of the container 14 is shown. The container 14 is generally a rectangular box having three separate compartments 22, 24 and 26 stacked one above the other and divided by walls 28. Each of the compartments has predetermined internal dimensions and an opening 30 which corresponds in size to the discharge opening 32 of the compactor assembly 18. As each compartment is filled with a bale 34, a temporary cover 36 is placed over the bale and attached to the container to hold the bale in place. Preferably, the attachment structure includes threaded bolts 62 which are threaded over the outer edges of the temporary cover to hold it in place until the entire container is filled. Once filled, the permanent cover 38 is installed and the container can then be shipped to the location of permanent storage.

To fill the container 14, the container must be moved relative to the compactor assembly to sequentially present each of the openings 30 before the discharge opening 32 to receive a bale 34. The container must be accurately positioned so that the ram 20 can simply drive the finished bale into a compartment.

Figure 3:
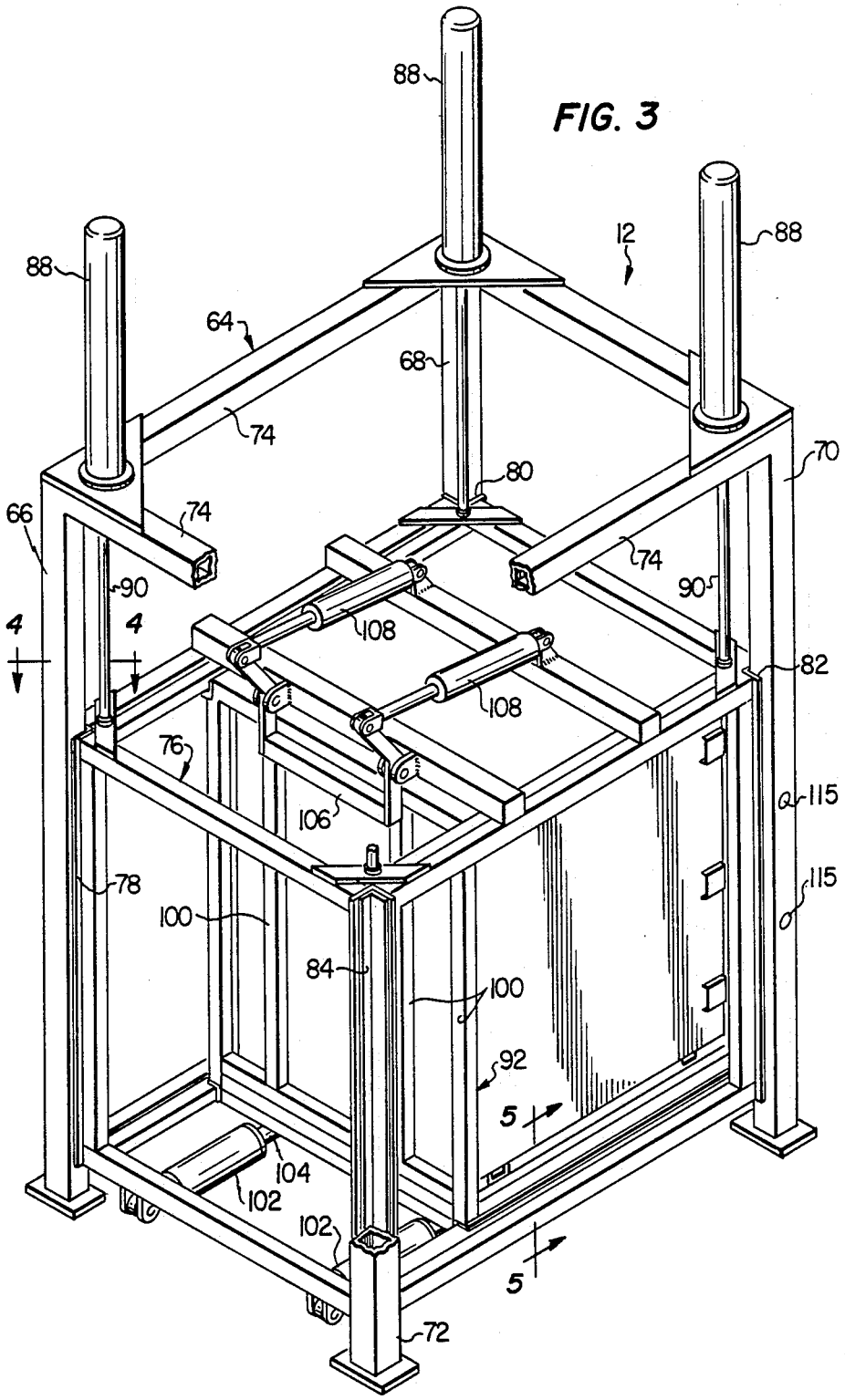
FIG. 3 is an exploded perspective view of the components of the container handling apparatus.

With reference now to FIG. 3, the container handling apparatus 12 will be described. The apparatus 12 includes a stationary frame 64 which is positioned about the discharge opening 32 and can be fastened to the compactor assembly 18. The stationary frame 64 includes four vertical beams 66, 68, 70 and 72 interconnected by cross beams 74 to form a rigid frame. One side of the stationary frame has sufficient space for passage of the container to a position inside the frame. Typically, the container will be moved into and out of the frame by a forklift or similar equipment.

Figure 4:
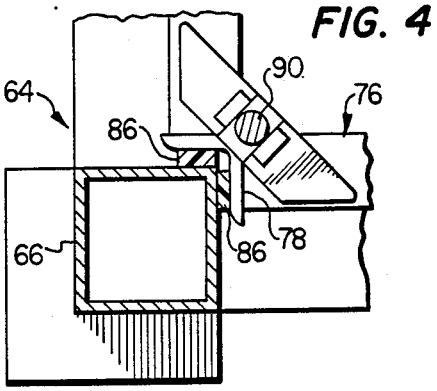
FIG. 4 is a horizontal cross sectional view of the guide assembly for guiding the container vertically.

Positioned within the stationary frame 64 for vertical motion relative thereto is a movable frame 76. The movable frame 76 has angle frame members 78, 80, 82 and 84 at each of its corners. The interior of each angle frame member faces a stationary vertical beam and is guided thereby for vertical motion. Nylon guide blocks 86 are mounted on each interior face of the angle frame member so that each angle frame member bears against two transverse sides of each stationary vertical beam as best seen in FIG. 4.

A double acting vertical lift cylinder 88 is mounted to stationary frame 64 at each stationary vertical beam. The rod 90 of each cylinder 88 is pivotally attached to the top of the movable frame 76 at the angle frame member bearing on the stationary vertical beam. By providing pressurized hydraulic fluid to the four cylinders 88 simultaneously, the movable frame can be moved either up or down without binding.

Within the movable frame 76 is positioned a second movable frame 92. The movable frame 92 includes horizontal beams 94 which slide along horizontal angle frame members 96 forming part of the movable frame 76. Nylon blocks 86 guide the angle frame members along the horizontal frame members toward and away from the discharge opening 32. The movable frame 92 also includes vertical frame members 100 extending upward from the ends of the beams 94 distant from the discharge opening. The container is thus supported on two sides by beams 94 and frame members 100.

Twin double acting horizontal cylinders 102 are mounted on movable frame 76 with their rods 104 mounted on movable frame 92. Simultaneous entry of hydraulic fluid to cylinders 102 controls the movement of frame 92, and the container 14, toward and away from the discharge opening of the compactor assembly 18.

A locking bar 106 is pivotally attached to the movable frame 76 and can pivot from a position permitting the frame 92 to move horizontally along frame 76 to a locking position where the bar locks the frame 92 in a position with the container forced against the discharge opening 32. Activation of the locking bar is performed by a pair of double acting hydraulic cylinders 108 acting between the frame 76 and the locking bar 106.

In operation, an empty container 14 is inserted within the frames 64 and 76 to rest on frame 92. Pressurized hydraulic fluid is supplied from a pump (not shown) to the cylinders 88 to lift the frames 76 and 92 and container 14 upward until the lowermost compartment opening is at the same level as discharge opening 32. A limit switch 112 will sense movement of the container to this position o stop vertical movement.

Figure 7:
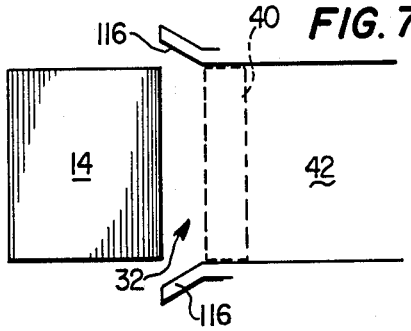
FIG. 7 is a schematic view of the structure guiding the container to receive a bale.
Figure 5:
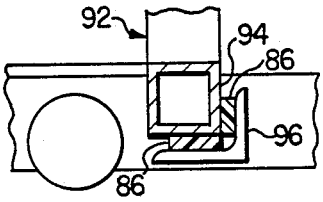
FIG. 5 is a vertical cross sectional view of a guide assembly for guiding the container for horizontal motion.

The control circuit 114 activates the horizontal cylinders 102 to move the frame 92 and container 14 toward the discharge opening. Vertical guide plates 116 are positioned on the compactor assembly 18 on each side of the discharge opening 32 to horizontally orient the container 14 as it approaches the discharge opening to ensure that the openings are matched (see FIG. 7). A limit switch 118 senses when the container is in the proper position against the compactor assembly for receiving a bale and the control circuit then deactivates cylinders 102. The cylinders 108 are activated to pivot locking bar 106 into a locking position as sensed by limit switch 119 to prevent the container from backing away from the discharge opening 32. The control circuit 114 then causes gate 40 to lift until opened (indicated by limit switch 124) and the ram 20 to drive a finished bale 34 into the lowest compartment 22. A temporary cover 36 is secured on the face of the ram 20 by a frangible material, such as copper or aluminum wire. When the ram has moved the bale into compartment 22, the ram is stopped and the threaded bolts 62 at compartment 22 are screwed over cover 36 through apertures 115 provided in the stationary vertical beams 68 and 70 to hold the temporary cover within the compartment. The ram is then withdrawn, breaking the frangible material holding the cover to the ram.

Prior to initiating the next bale forming sequence, control circuit 114 causes cylinder 108 to unlock the locking bar 106, and then cylinders 102 are energized to back off the movable frame 92 and container to permit a new temporary cover 36 to be mounted on the exposed end of the ram 20. Limit switch 121 senses movement of locking bar 106 to the unlocked position, whereupon control circuit 114 halts movement of cylinders 108. Limit switch 123 senses movement of frame 92 to its retracted position, whereupon control circuit 114 halts movement of cylinders 102. Once a new temporary cover has been mounted and the ram has been retracted, the gate 40 is again closed (indicated by switch 126) and the next compaction cycle is undertaken to form a new bale.

Once the second bale for container 14 is formed, the control circuit 114 causes the cylinders 88 to lower frames 76, 92 and the container so that the middle compartment 24 is at the level of the discharge opening. Movement to this position is sensed by limit switch 120 which stops the motion (limit switch 122 senses movement to the lowest position). Again, control circuit 114 moves the container against the compactor assembly to receive a bale within compartment 24. This sequence reoccurs until all compartments are filled in the container, whereupon the container is moved away from the compactor assembly and to the position for removal through the side of the stationary frame 64 by a forklift or other device.

Thus, it can be seen that the present invention provides for handling a multicompartment container to sequentially position each compartment opening at the discharge opening of a compactor assembly. Further, the length of the compacted bale can be closely controlled by the ram control circuitry to ensure that an overlength bale will virtually never be encountered.

While one embodiment of the present invention has been illustrated in the accompanying drawings and described in the foregoing detailed description, it will be understood that the invention is not limited to the embodiment disclosed, but is capable of numerous rearrangements, modifications and substitutions of parts and elements without departing from the spirit of the invention.

We claim:

1. An apparatus for facilitating the loading of bales of compacted waste from a compactor into a multi-compartment container, the waste being discharged from the compactor through a discharge opening of predetermined dimensions, each compartment of the container having an opening of similar dimensions, comprising:

a stationary frame positioned proximate the discharge opening;

a first movable frame positional within the perimeter of the stationary frame supporting the multi-compartment container;

first guide means acting between the stationary frame and first movable frame for guiding the movable frame and container in a first direction in a plane parallel the discharge opening for sequentially aligning the opening in each of the compartments of the container with the discharge opening of the compactor;

second guide means mounted on the compactor for orienting the container in a direction transverse the first direction in the plane parallel the discharge opening for aligning each compartment with a discharge opening.

2. The apparatus of claim 1 employing a ram for compressing waste material into bale form within a compaction chamber, the improvement further comprising:

means for measuring the incremental increase in bale length for each stroke of the ram as the bale is formed;

means for computing a running average of the incremental increase in length;

means for operating the ram in full stroke until the difference between the desired bale length and actual bale length is equal to or less than the larger of the average incremental length increase and the last increment length increase; and means for limiting the last stroke of the ram to a ratio equal to the additional length to complete the bale over the larger of the average incremental length and last incremental length to complete the bale.

3. An apparatus for facilitating the loading of bales of compacted waste from a compactor into a multi-compartment container, the waste being discharged from the compactor through a discharge opening of predetermined dimensions, each compartment of the container having an opening of similar dimensions, comprising:

a stationary frame positioned proximate the discharge opening;

a first movable frame positional within the perimeter of the stationary frame supporting the multi-compartment container;

first guide means acting between the stationary frame and the first movable frame for guiding the movable frame and container in a first direction in a plane parallel the discharge opening for sequentially aligning the opening in each of the compartments of the container with a discharge opening of the compactor, wherein said first guide means includes nylon blocks mounted to one of said frames for sliding said first movable frame relative to the stationary frame.

4. The apparatus of claim 3 employing a ram for compressing waste material into bale form within a compaction chamber, the improvement further comprising:

means for measuring the incremental increase in bale length for each stroke of the ram as the bale is formed;

means for computing a running average of the incremental increase in length;

means for operating the ram in full stroke until the difference between the desired bale length and actual bale length is equal to or less than the larger of the average incremental length increase and the last increment length increase; and means for limiting the last stroke of the ram to a ratio equal to the additional length to complete the bale over the larger of the average incremental length and last incremental length to complete the bale.

5. An apparatus for facilitating the loading of bales of compacted waste from the compactor into a multi-compartment container, the waste being discharged from the compactor through a discharge opening of predetermined dimensions, each compartment of the container having an opening of similar dimensions, comprising:

a stationary frame positioned proximate the discharge opening;

a first movable frame positional within the perimeter of the stationary frame supporting the multi-compartment container;

first guide means acting between the stationary frame and first movable frame for guiding the movable frame and container in a first direction in a plane parallel the discharge opening for sequentially aligning the opening in each of the compartments of the container with a discharge opening of the compactor;

a second movable frame supporting the multi-compartment container;

a second guide means acting between the first and second movable frames for guiding the second movable frame container for motion in a second direction transverse the plane of the discharge opening for moving the container toward and away from the discharge opening;

locking means for locking the container against the compactor for insertion of a bale within the container.

6. The apparatus of claim 5 employing a ram for compressing waste material into bale form within a compaction chamber, the improvement further comprising:

means for measuring the incremental increase in bale length for each stroke of the ram as the bale is formed;

means for computing a running average of the incremental increase in length;

means for operating the ram in full stroke until the difference between the desired bale length and actual bale length is equal to or less than the larger of the average incremental length increase and the last increment length increase; and means for limiting the last stroke of the ram to a ratio equal to the additional length to complete the bale over the larger of the average incremental length and last incremental length to complete the bale.

7. An apparatus for facilitating the loading of bales of compacted waste from a compactor into a multi-compartment container, the waste being discharged from the compactor through a discharge opening of predetermined horizontal and vertical dimensions, each compartment of the container having an opening of similar dimensions, comprising:

a stationary frame including a plurality of frame members oriented in a first direction;

a first movable frame positioned within the perimeter of the stationary frame defined by the frame members of the stationary frame, the first movable frame having a frame member extending in the first direction facing each of the frame members of the stationary frame, said frame members of the stationary frame and first movable frame cooperating to confine the first movable frame for sliding motion relative to the stationary frame along the first direction.

8. The apparatus of claim 7 wherein one of said facing frame members comprises a beam having first and second transverse surfaces extending along the first direction and the other facing frame member comprises an angle member having first and second transverse surfaces extending along the first direction.

9. The apparatus of claim 7 further comprising a second movable frame positioned within the first movable frame and slidable thereon for sliding motion toward and away from the discharge opening.

10. The apparatus of claim 9 further including means for locking the second movable frame and container in a position to receive a bale from the compactor.

11. The apparatus of claim 7 further comprising nylon blocks mounted on one of said frame members for bearing against the facing frame member to facilitate sliding and prevent binding as the first movable frame slides along the stationary frame.

12. The apparatus of claim 7 employing a ram for compressing waste material into bale form within a compaction chamber, the improvement further comprising:

means for measuring the incremental increase in bale length for each stroke of the ram as the bale is formed;

means for computing a running average of the incremental increase in length;

means for operating the ram in full stroke until the difference between the desired bale length and actual bale length is equal to or less than the larger of the average incremental length increase and the last increment length increase; and means for limiting the last stroke of the ram to a ratio equal to the additional length to complete the bale over the larger of the average incremental length and last incremental length to compete the bale.

* * * * *

UNITED STATES PATENT AND TRADEMARK OFFICE

CERTIFICATE OF CORRECTION

PATENT NO. : 4,833,866

DATED : May 30, 1989

INVENTOR(S) : Newton, et al.

It is certified that error appears in the above-identified patent and that said Letters Patent is hereby corrected as shown below:

Column 8, lines 61 and 62, before dimensions, insert --horizontal and vertical--.

Signed and Sealed this

Twenty-first Day of September, 1993

Bruce Lehman

*Attest:*

BRUCE LEHMAN

*Attesting Officer*

*Commissioner of Patents and Trademarks*